United States Patent [19]

Guggemos

[11] Patent Number: 4,486,754

[45] Date of Patent: Dec. 4, 1984

[54] LIGHTED WIND CONE FOR EVACUATION AID

[75] Inventor: Kenneth F. Guggemos, Buffalo, Minn.

[73] Assignee: Sterner Lighting Systems Incorporated, Winsted, Minn.

[21] Appl. No.: 342,232

[22] Filed: Jan. 25, 1982

[51] Int. Cl.[3] ..... G08G 5/00

[52] U.S. Cl. ..... 340/949; 73/178 T

[58] Field of Search ..... 73/178 T, 188; 340/25, 340/26, 84, 321, 870.16, 947, 949; 33/348; 40/479, 480, 553, 564; 116/63 C

[56] References Cited

U.S. PATENT DOCUMENTS

| | | | |
|---|---|---|---|
| 1,496,486 | 6/1924 | Pedu | 340/26 |
| 1,605,086 | 11/1926 | Watson | 340/26 |
| 1,742,574 | 1/1930 | Breedlove | 73/188 |
| 1,776,111 | 9/1930 | Donaldson | 73/188 |
| 1,946,351 | 2/1934 | Boyle | 73/55 |
| 4,046,007 | 9/1977 | Tally, Jr. | 73/188 |
| 4,201,973 | 5/1980 | Jackson et al. | 340/26 |
| 4,204,271 | 5/1980 | Braly | 362/145 |
| 4,241,604 | 5/1980 | Hergenrother | 340/26 |

FOREIGN PATENT DOCUMENTS

| | | | |
|---|---|---|---|
| 216329 | 12/1956 | Australia | 116/63 C |

*Primary Examiner*—James J. Groody
*Assistant Examiner*—Michael F. Heim
*Attorney, Agent, or Firm*—Kinney & Lange

[57] ABSTRACT

An evacuation aid for a high rise building comprising a wind cone lighting device which can be operated for a substantial period of time under emergency power conditions such as from a battery supply. The wind cone is lighted by a single light rotating with the wind cone and powered through slip ring assemblies.

6 Claims, 6 Drawing Figures

FIG. 4
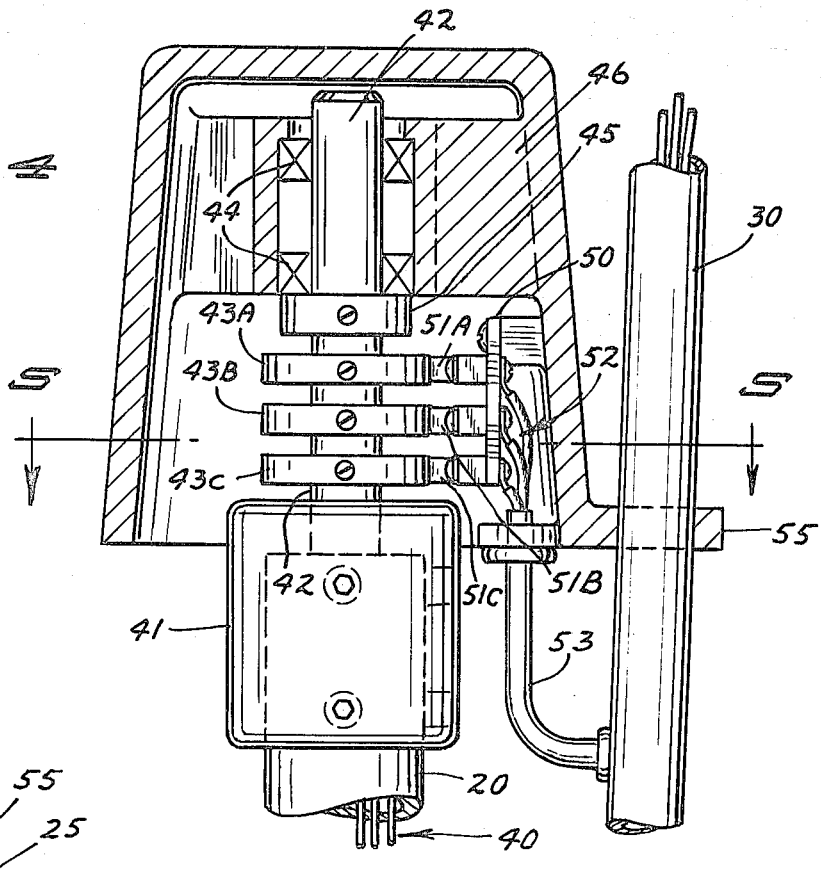
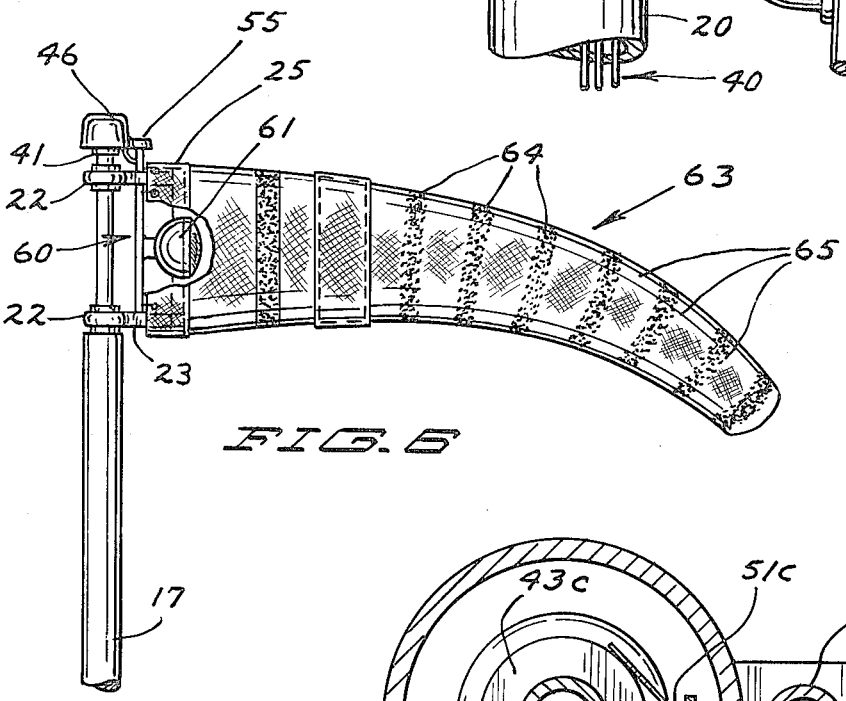
FIG. 6
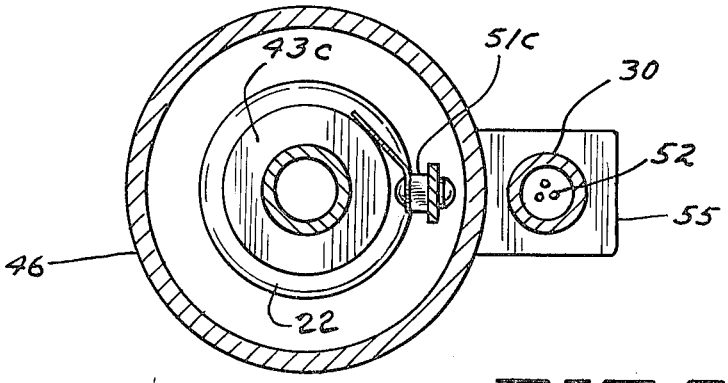
FIG. 5

LIGHTED WIND CONE FOR EVACUATION AID

BACKGROUND OF THE INVENTION

1. Field of the Invention

The present invention relates to wind cone lighting devices used as evacuation aids for landing aircraft on high rise buildings and other areas where emergency power lighting may be necessary.

2. Description of the Prior Art

The importance of evacuation aids in high rise buildings came to the forefront only in recent times, when in the United States and in other countries disasters have occurred because the fire department ladders could not reach upper floors (generally not above the tenth floor) and helicopters could not land on the tops of the buildings under prevailing wind conditions because of lack of adequate wind direction indication in darkness.

There have, of course, been many lighted wind direction indicators for landing fields advanced in prior years. These are fixed ground installations where adequate power is not a problem and the lighting can be a circle of fixed lights that illuminate a wind cone, or more commonly for wind cones there are four lights, one at each of the major points of the compass, that will provide a ring of light around the wind cone so that its position can readily be seen from the air. A plurality of lights, of course, increases the amount of power consumed and in emergency situations power can be of utmost importance.

For example, lighted wind cones are shown in U.S. Pat. No. 1,776,111. Here a fixed bulb is provided at the top. This type of light does not illuminate the cone well and provides a glare that restricts the appearance of the cone. However, in FIG. 4, a movable contact arm is used for providing signals to a remote wind direction indicator. The movable contact is not used for carrying power to the light. A similar type of device is shown in U.S. Pat. No. 4,201,973 in FIG. 2. In both of these instances, therefore, one of the main supports has to rotate, because the contacts are adjacent the base of the unit. Furthermore, the contacts are used for providing a signal indicating wind direction, and not for illuminating the indicator. A remote wind direction indicator is illuminated with the signal provided by the circular slide contact.

U.S. Pat. No. 4,204,271 shows an illuminated weather vane for mounting on the top of a home or building which has a translucent globe with a light inside that is intended to provide some lighting to the weather vane.

Additionally, in the course of a preliminary search patents of general interest were uncovered and included U.S. Pat. No. 4,046,007 and U.S. Pat. No. 1,946,351. These merely show different types of wind direction indicators.

SUMMARY OF THE INVENTION

The present invention relates to a wind cone lighting arrangement suitable for use as an evacuation aid where emergency power, either a battery or a small generator, is likely to be needed. The wind cone is utilized for indicating wind direction for a helicopter that can be landed on the top of a high rise building for example, and is illuminated from a stand-by or emergency power source by a single light rotated directly with the wind cone. The light is powered through slip rings mounted on the stationary wind cone support.

The support pole for the wind cone thus can be a sturdy conventional pole that does not rotate and is securely fastened to a base or the like. The only rotating portion would be the wind cone and single light. A slip ring and brush assembly that can be easily weatherproofed, simply made and easily installed is used to transmit power to the rotating light.

Specifically the device is intended for use as an emergency evacuation aid for high rise buildings and is intended to be installed on the top of such a high rise building. The use of a single light that directly illuminates the wind cone and then rotates with the wind cone eliminates the need for extra lights and provides adequate illumination regardless of the wind direction. The single light can be a low power consumption light. The present day incandescent flood lights used for wind cones that are ground installed draw too much current for use on an emergency battery power system for any reasonable length of time.

As shown, the light can be either mounted above the wind cone or below the wind cone, and in one embodiment can be used to illuminate the interior of the wind cone directly, with the wind cone being suitably formed so the light would be visible through the cone at least at selected segments of the cone.

BRIEF DESCRIPTION OF THE DRAWINGS

FIG. 4 is a vertical sectional view of an upper slip ring housing shown in FIG. 1;

FIG. 5 is a sectional view taken as on line 5—5 in FIG. 4; and

FIG. 6 is a view of a modified embodiment of the present invention.

DETAILED DESCRIPTION OF THE PREFERRED EMBODIMENTS

Figure 1:
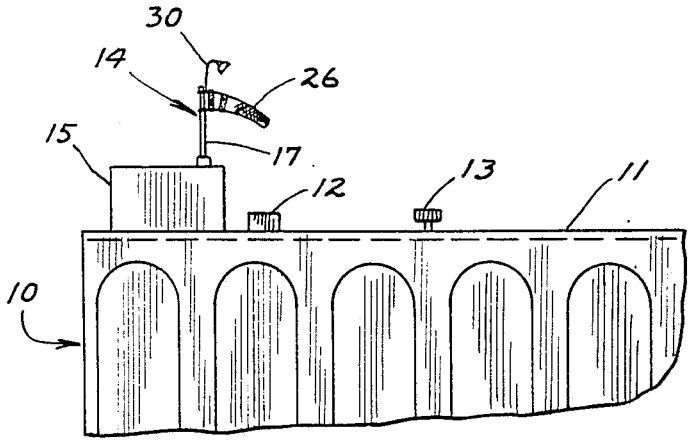
FIG. 1 is a fragmentary side view of a typical high rise building showing a wind cone made according to the present invention as part of an emergency evacuation system installed thereon.

Referring to FIG. 1, a high rise building indicated at 10 is of the type that may have inhabitants in the building and in view of recent tragedies that have occurred in hotels and the like, an emergency evacuation system for permitting the night landing of helicopters is provided on the roof 11 of the building. The emergency evacuation system includes for example a standby power supply 12 that is mounted on the roof and can comprise a battery pack for an emergency power supply, or a small self-contained generator. Gasoline storage is a problem for large generators so usually the fuel supply is limited if a generator is provided. Additionally, there can be lighting 13 of a suitable type for providing at least partial illumination of a landing area on the roof. Of critical importance is a wind cone assembly indicated at 14 that is mounted adjacent to the landing area on the high rise building 10.

The wind cone assembly 14 as shown is supported on a suitable support or mounting 15, which in the case shown could be a housing for building air conditioning units or the like. A base member 16 is used for mounting an upright tubular pole 17 of conventional design.

The base member 16 may be a base that hinges to permit the pole 17 to be pivoted downwardly so that the upper end of the pole is lowered to a portion adjacent the support 15 for servicing. However, any type of base can be utilized if desired.

The pole 17 normally can be tapered and in the range of five to six inches in diameter at its base. A smaller outside diameter, tubular shaft section such as that indicated at 20 is mounted to the top of the pole 17 in a suitable manner. The upper shaft section 20 in turn rotatably mounts a suitable wind cone assembly 21 thereon for rotation about the axis of the upper shaft section 20. This mounting can comprise a pair of vertically spaced bearings 22,22 which have housings that are rotatably mounted on the upper shaft section 20, and have outwardly extending bracket portions 23,23 to which a rigid sleeve or other suitable cone support indicated at 25 can be attached. Support 25 is usually bolted in place onto the brackets 23, and then a fabric or other suitable material tubular cone tail sleeve 26 is attached to the support 25 in a suitable manner. The cone tail sleeve of course is of conventional design and extends outwardly in proportion to the wind velocity, and will rotate about the shaft section 20 or brackets 23 to indicate the direction of wind. This construction is well known and is shown only schematically, and any desired method for holding the tubular cone tail sleeve 26 may be used. Usually these wind cone tail sleeves are slightly conical with a very small cone angle and terminate with a truncated end portion indicated at 27 in FIG. 2.

In order to make the wind cone assembly suitable for use in emergency situations and at night, the tail sleeve 26 has to have some illumination. As shown in the first embodiment, a lamp support conduit indicated at 30 is securely mounted to the upper one of the brackets 23 in one form, or alternately to the lower one of the brackets 23 as shown in dotted lines in FIG. 2. At the outer end of the conduit 30, which assumes a generally J shape, a lamp socket or support housing 31 is adjustably mounted about a pivot bolt 32 and carries a lamp 33 of suitable type that is adjusted so that the light from the lamp will shine directly onto the wind cone tail sleeve 26.

Also it should be noted that the lamp support conduit 30 therefore rotates with the wind cone support, so that whenever the lamp 33 is illuminated, the light will shine onto the wind cone tail sleeve 26 and will rotate with the wind cone as the wind shifts direction. Thus the light is steady on the wind cone tail sleeve and keeps it illuminated satisfactorily.

In order to power the light 33, a slip ring assembly is used for transferring power from the stationary portions of the wind cone assembly to the rotating portions. As shown in FIG. 4, the upper tubular shaft section 20, as well as the post 17 have electrical wires indicated at 40 therein. A slip fitter collar 41 is mounted over the upper end of the shaft section 20 and this collar in turn carries a support tube 42 on which a plurality of annular slip rings 43A, 43B and 43C are mounted. For a three wire system, three of the slip rings are utilized, and of course it can be seen that these slip rings do not rotate, but rather are stationary with respect to the shaft portion 20. Each of the slip rings is connected to a separate one of the wires 40, to carry the necessary power to the slip ring assembly.

The upper end of the tube 42 is used for mounting a pair of bearings 44, which are held in place with a suitable collar 45. The collar 45 is fixed to the shaft section 20, and the outer races of the bearings are used for mounting an aluminum housing 46 which will rotate relative to the tube 42 on the bearings 44. Housing 46 in turn has a brush bracket indicated at 50 mounted thereon and carrying a plurality of brushes 51A, 51B and 51C, respectively that mate with and electrically engage the respective slip rings 43A, 43B and 43C. Each of the brushes in turn has an electric wire indicated generally at 52 attached thereto and carried in a conduit 53 that is fixed to the housing 46.

The conduit 53 then taps into the lamp support conduit 30 and it can be seen that the lamp support conduit also is fixed to an ear 55 of the aluminum housing 46. As shown the conduit 30 slips through an opening in the ear. Therefore the aluminum housing 46 rotates with the lamp support conduit 30 and also with the wind cone support and tail sleeve 26 so that the power for the light 33 is carried by wires 52 from the brushes which in turn receive electrical energy from the slip rings 43A, 43B and 43C. Because the slip rings 43A, 43B and 43C are stationary, power from the emergency power source 12 can readily be connected to the slip rings by the wires 40.

While the lamp support conduit 30 is shown mounted through the ear 55, it is of course understood that any suitable type of bracket could be utilized for clamping the lamp support assembly, whether it is a conduit as shown at 30 or other support assembly, to the rotating housing 46 and to the bracket 23 that mount the wind cone.

Figure 2:
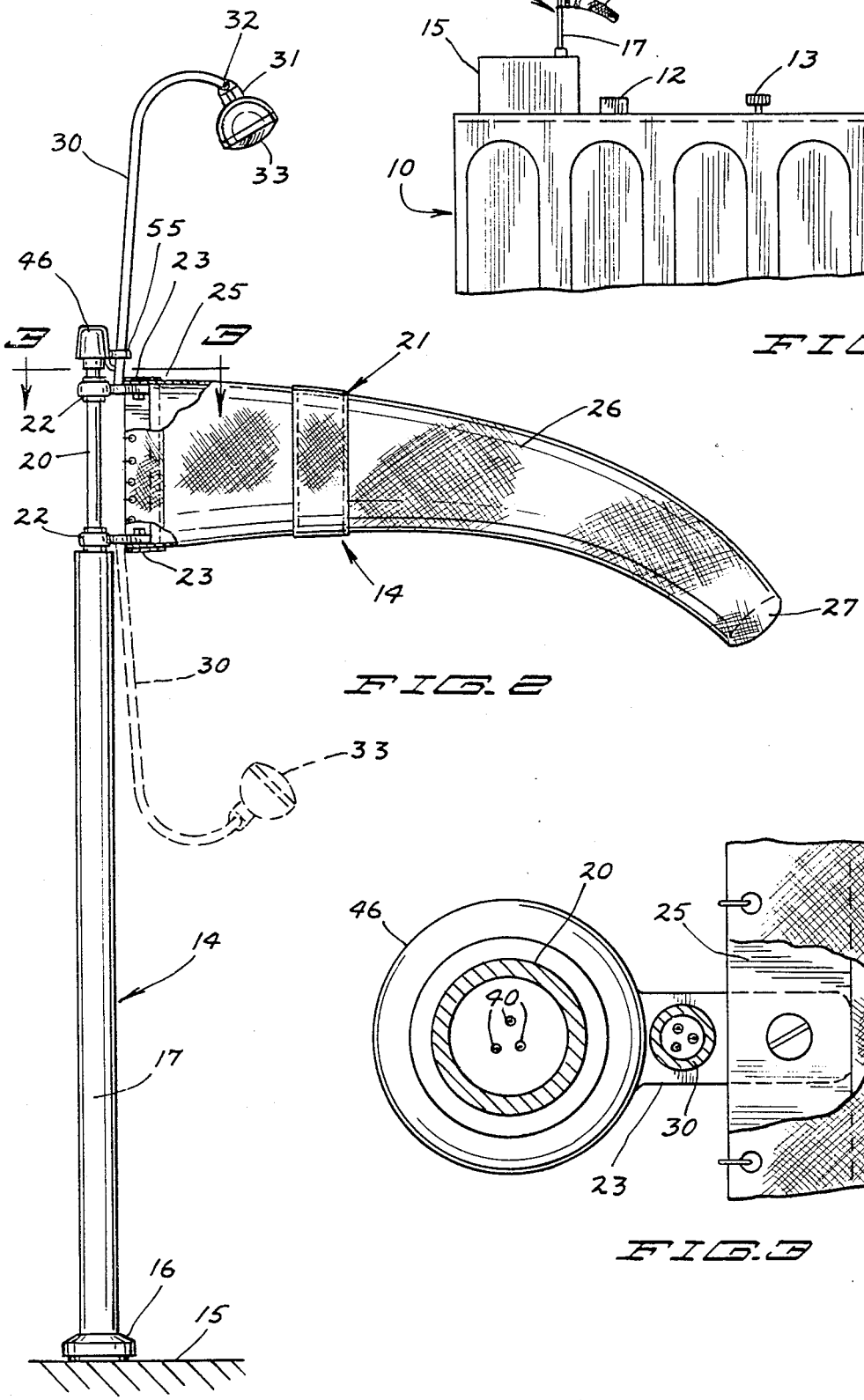
FIG. 2 is an enlarged side view of the wind cone shown in FIG. 1.
Figure 3:
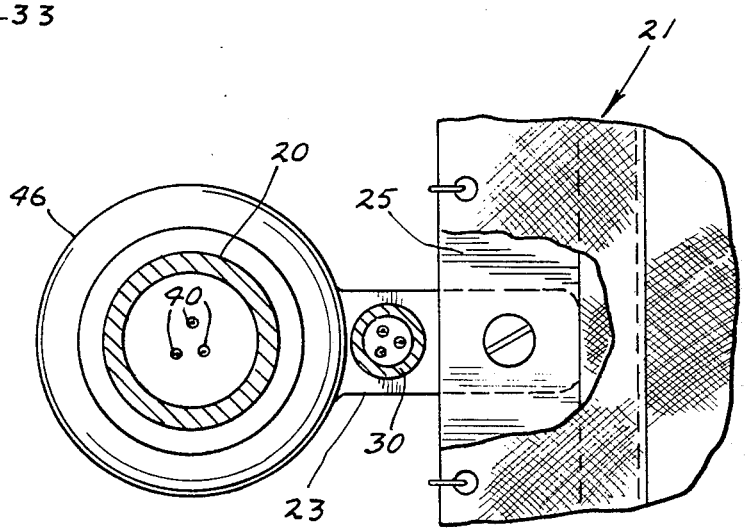
FIG. 3 is a sectional view taken as on line 3—3 in FIG. 2 with parts broken away.

An alternate position of the lamp 33 is shown in dotted lines in FIG. 2. The conduit 30 can be attached to the lower bracket 23 with suitable clamps and positioned to shine upwardly onto the wind cone tail sleeve. The light position thus is a matter of individual choice.

In FIG. 6 a modified form of the assembly is shown. The tubular shaft section 20, together with the bearings 22 and brackets 23 are exactly the same. Likewise, a wind cone support sleeve 25 is mounted on these brackets 23 in the same manner, but in this instance, there is a lamp support member 60 that extends between the brackets 23,23 and a lamp 61 (mounted in a suitable housing) is also mounted between the brackets 23 and the within the outer wind cone mounting sleeve 25. The lamp 61 thus shines directly out along the axis of the wind cone mounting sleeve 25.

It can be seen that the support 60 can be attached to the ear 55 of the housing 46 in a suitable manner, so that the power coming from the slip ring assembly in the form of the invention shown in FIG. 6 is transferred to the lamp 61 on the interior of the wind cone support 25. In this particular instance, the wind cone support 25 mounts a wind cone sleeve 63 which is alternately opaque and translucent, so that the light 61 will alternately shine through the sleeve through translucent or transparent stripes or sections 65 and be blocked by the opaque stripes indicated at 64 on the wind cone sleeve 63. When the light is on the wind cone is readily visible from an aircraft that is landing. In this manner, the single light 61 is on the interior of the wind cone and because the wind cone is striped with alternately opaque and transparent or translucent strips, the wind cone is highly visible with a single light 61 which rotates with the wind cone.

Although the present invention has been described with reference to preferred embodiments, workers skilled in the art will recognize that changes may be made in form and detail without departing from the spirit and scope of the invention.

What is claimed is:

1. An emergency evacuation device for indicating wind direction for evacuation air vehicles comprising a support kpost, a wind cone assembly having a mounting end with a perimeter defining an opening leading to an interior space within the wind cone assembly and being rotatably mounted on said support post, an illumination source comprising a lamp assembly, means to mount said lamp assembly for rotation with said wind cone assembly relative to said post, said slip ring means including a rotatable portion carried with said wind cone assembly and lamp assembly and a stationary portion mounted on said post for transmitting electrical power from the stationary post to said lamp assembly, said lamp assembly comprising a lamp holder mounted adjacent the mounting end of said wind cone assembly, a lamp mounted on said lamp holder, said lamp being positioned within the perimeter of said wind cone assembly and directing light into the interior of said wind cone assembly, said wind cone assembly including a wind cone sleeve having alternating portions of first and second different light transmitting properties to provide a pattern of alternating lighter and darker portions when the lamp is powered.

2. The apparatus of claim 1 wherein the wind cone sleeve has annular opaque stripes spaced along the length of the sleeve.

3. The device of claim 1 wherein said power is provided from an emergency power supply.

4. The device of claim 1 wherein said post is tubular and has an upper end, and electrical wires are passed up through said post to said slip ring means, said slip ring means being mounted at the upper end of said post, and a housing having a closed end mounted on the upper end of said post with portions of the housing surrounding said slip ring means, and the closed end overlying the upper end of the post to protect the slip ring means from weather.

5. The device of claim 1 wherein said device is mounted on a highrise building, the power supply mounted on said building and providing power to said slip ring means.

6. An emergency evacuation device for indicating wind direction for evacuation air vehicles comprising a hollow support post having an upper end portion and a top opening; a wind cone assembly rotatably mounted on said support post adjacent the upper end portion but below the top opening; said wind cone assembly comprising a support defining an opening, a wind cone having a base end and an outer end and being mounted on the support at its base end to define a wind cone opening, said wind cone defining an interior cavity; an illumination source comprising a lamp assembly; means to mount said lamp assembly for rotation with said wind cone assembly relative to said post; slip ring means including a support coupled to the post and extending above the top opening, at least one electrically conductive ring member fixed to said support and surrounding said support, and a housing rotatably mounted on the support and having a closed end overlying the support, said housing carrying electrically connected brushes for each ring member, each brush aligning with one of the ring members; means to couple each ring to an electrical power supply; means to couple each brush to power the lamp assembly; and means to mechanically couple the wind cone assembly and lamp assembly to the housing to cause the housing to rotate with the wind cone assembly; said lamp asssembly comprising a single lamp holder mounted to move with said wind cone assembly as the wind cone assembly rotates, the lamp holder being positioned adjacent the base end of the wind cone and within the opening defined by the support, and a lamp mounted in the lamp holder and positioned to project light into the interior cavity of the wind cone, said wind cone having first and second portions of different light transmitting properties to provide a pattern of alternate light and darker portions on the wind cone when the lamp is powered.

* * * * *